United States Patent [19]

Schmid et al.

[11] 4,357,570

[45] Nov. 2, 1982

[54] VOLTAGE COMPENSATION FOR AN A-C NETWORK SUPPLYING A RAPIDLY-CHANGING LOAD

[75] Inventors: Eberhard Schmid, Dormitz; Wolfgang Kaufhold, Erlangen, both of Fed. Rep. of Germany

[73] Assignee: Siemens Aktiengesellschaft, Munich, Fed. Rep. of Germany

[21] Appl. No.: 189,109

[22] Filed: Sep. 22, 1980

[30] Foreign Application Priority Data

Sep. 27, 1979 [DE] Fed. Rep. of Germany ..... 2939251
Jun. 19, 1980 [EP] European Pat. Off. ..... 80103430.7

[51] Int. Cl.[3] ..... G05F 1/70
[52] U.S. Cl. ..... 323/210; 323/211
[58] Field of Search ..... 323/209–211, 323/222, 223, 225

[56] References Cited

U.S. PATENT DOCUMENTS 4,001,671 1/1977 Gyugyi et al. ..... 323/211
4,143,315 3/1979 Kelley ..... 323/210
4,156,176 5/1979 Gyugyi ..... 323/210

*Primary Examiner*—William H. Beha, Jr.
*Attorney, Agent, or Firm*—Kenyon & Kenyon

[57] ABSTRACT

A circuit for controlling the voltage of a network which supplies electrical power to a load having a rapidly varying impedance. The circuit contains a pair of controlled electric valves which are connected in parallel between two conductors of the network and poled for condition in opposite directions. A voltage transformer produces a signal corresponding to the network voltage, which signal is conducted to an integrator and subsequently compared to a preset mean value. The preset mean value corresponds to a desired amplitude at which the positive and negative half-wave cycles of the network voltage are desired to be maintained. In one embodiment, the controlled electric valves are caused to conduct current during respective half-waves of network voltage so as to maintain the amplitudes of the half-waves at the present mean value. Other features are described for compensating for long term drift of the network voltage and for controlling the controlled electric valves by means of logic circuitry.

10 Claims, 9 Drawing Figures

VOLTAGE COMPENSATION FOR AN A-C NETWORK SUPPLYING A RAPIDLY-CHANGING LOAD

BACKGROUND OF THE INVENTION

This invention relates to circuits for compensating for voltage variations in a supply network, and more particularly, to a circuit for maintaining constant a voltage across two conductors of an A-C supply network which supplies a load having a rapidly changing impedance.

A circuit which is commercially used to control the voltage of a supply network which supplies electric power to furnaces which are used in the manufacture of steel and the melting of scrap is described in "Siemens-Forschungs-und Entwicklungs-Bericht", Vol. 6 (1977), pp. 29 to 38. In an electric furnace for making steel or melting scrap, an electric arc which is produced between the electrodes of the circuit and the material to be melted is randomly interrupted as the material melts. Such widely varying load impedances are also found in rolling mills which contain pulse power supplies for operating synchrotrons or converter drives. The rapid and wide excursions in the amplitude of the voltage and current can create problems to other consumers of electric power on the same network. Although a supply network may have an impedance which has a negligible resistive component, such networks may have large reactive impedances which produce large reactive currents in response to the voltage variations. For example, other electric power consumers which employ incandescent lamps connected to the supply network will be subjected to annoying fluctuations in brightness. It is necessary to suppress the effects of such load variations and the consequential reactive currents because most such loads cause the incandescent lamps to flicker in the frequency range of 3 to 10 Hz, and at amplitudes of 0.5%, which are in the ranges perceivable by the human eye.

The circuit described in the above publication is provided with a battery of capacitors connected in shunt with a load which is connected to a three-phase supply network, the capacitors being capable of providing as much reactive current as the load may maximally consume. The circuit is further provided with a three-phase control element having electric valves which are connected to the supply network and which are fired by means of a Δ circuit. The three-phase control element consists of a choke connected in series with an A-C control element having two controlled switching valves which are connected in parallel to one another but poled for conduction in opposite directions. The valves are controlled by circuitry responsive to the current flowing through the load as well as the current flowing through the three-phase control elements. Such circuitry consists of a multiplicity of computing elements which perform the functions of coordinate transformation, vector identification and vector rotation. Such a system is expensive and complex.

It is, therefore, an object of this invention to provide a simple and fast acting control circuit which maintains the voltage level between the individual conductors of a single or multiphase supply network constant for at least a short time.

It is another object of this invention to maintain the voltage level between the conductors of a transmission network, illustratively between each phase conductor and a neutral conductor, or between two phases of a polyphase network, constant at a predeterminable mean value.

It is a still further object of this invention to maintain the voltage between the conductors in a transmission network constant at a predeterminable value responsive to a predetermined function, which may be a power of the voltage, so as to influence an RMS value of the voltage.

It is another object of the invention to selectively maintain the voltage between the conductors of a transmission network constant or permit such voltage to vary over a predetermined period of time of sufficient duration that the variations will not adversely affect other consumers.

SUMMARY OF THE INVENTION

The foregoing and other objects are achieved by this invention which provides a circuit for controlling the voltage between two conductors of an A-C supply network which supplies a rapidly varying load, the circuit having at least one electric valve which is poled to conduct current during a predetermined half wave of the voltage supplied by the transmission network, the valve being in a conductive state in response to a firing pulse which is produced in response to the output signal of an integrator which is responsive to the predetermined half-wave.

In one embodiment of the invention, a measuring device, which may be a voltage transformer, provides a voltage-responsive signal to an integrator which provides a signal corresponding to the integration of the network voltage to a firing pulse generator for each of two electric valves which are poled for conduction in opposite directions. The integration signal may be combined with an electrical value corresponding to a preset mean value, so as to place each electric valve in a conductive state when the integration signal, corresponding to the product of network voltage and time, equals and exceeds the preset mean value. In a further embodiment, the integration signal is combined with the preset mean value in a plurality of comparators which are connected at their outputs to respective limit indicators. Thus, each limit indicator receives a signal corresponding to the difference between the integration signal and the preset mean value. The limit indicator corresponding to the electrical valve which is poled to conduct during a positive half-wave of network voltages receives a signal which corresponds to the integration signal minus the preset mean value. On the other hand, the limit indicator which is associated with the electrical valve which conducts during the negative half-wave receives a signal corresponding to the sum of the integration signal and the preset mean value. The limit indicators thereby provide at their outputs respective signals which correspond to the difference between the absolute value of the integration signal and the preset mean value. Each limit indicator may be coupled at its output to a pulse former which transforms the signals from the respective limit indicator into a form suitable for driving the corresponding one of the electrical valves.

In some embodiments, the output signal of an A-C voltage integrator can be rectified and conducted to a single limit indicator for comparison with the preset mean value. The output signals of the limit indicator would be used for alternatingly firing the electrical control valves. Such a system would reduce the number of required components.

It is advantageous to connect a choke in series with the parallel combination of electrical valves between the network conductors. Such a coil would form a voltage divider in combination with the network inductance, and limit the amount of current flowing through the network and the electrical valves when the electrical valves are fired.

In embodiments of the invention wherein it is desirable to control the mean voltage value of the network so as to conform to a quantity related to the RMS value, it is advantageous to utilize a function generator disposed between the voltage measuring device and the integrator. Such a function generator would receive at its output a signal corresponding to the network voltage value V and to produce an output signal corresponding to $\pm|V|^a$, where $a>1$. The introduction into the circuit of such a function generator additionally causes the electrical valves to be operated earlier in time so as to permit a more rapid correction of a possible unacceptable voltage variation. In embodiments of the invention wherein a choke is used in series with the electrical valves, as described hereinabove, a voltage is developed across the choke, which voltage is integrated by the integrator, even after the electrical valves have been placed in a conductive state, and such a voltage may result in an undesirable deviation from the desired preset mean value. In such an embodiment, it is advantageous to correct for the choke voltage by providing a second integrator responsive to a signal which corresponds to the current flowing through the electrical valves. The advantageous preselection of the integration time constant of the second integrator results in an output signal which, when combined with the signal originally provided to the first integrator, shifts the initial conduction point of time of the respective valve so that the integral of the voltage remaining after conduction by the electrical valve is compensated, while the integral of each voltage half-wave corresponds to the desired preset mean value.

Although the circuit described hereinabove operates quickly, illustratively one second, to compensate for short term voltage fluctuations, the circuit generally need not compensate for relatively slow variations in load voltage, illustratively in the range of several seconds, because such slow variations have a less detrimental effect upon the electrical service provided to other consumers. It is desirable, however, to provide circuitry which will respond to such slow variations so as to provide a variable mean value which maintains a fixed relationship with respect to the network voltage. Thus, it is desirable to control the desired mean value so that it is always positioned in the center of its control range, as seen over several periods. Such an advantageous adjustment of the desired mean value is achieved by the use of a series circuit having a rectifier, a smoothing filter, and a Pi-circuit. The output of the Pi-circuit is used to determine the mean reference value.

It is desirable in some embodiments to control the electrical valves so as to prevent the current flowing through the valves from decreasing to less than a predetermined minimum. Supplemental firing signals are produced for the electrical valves by a line synchronized control unit. The line synchronized control unit provides the supplemental firing pulses if the time during which an electrical control valve is in a non-conductive states exceeds a predetermined maximum time period. The maximum non-conductive time can be preset by circuitry contained within the line synchronized control unit. In addition to compensating for long term network voltage drifts, the line synchronized control unit will also correct for undesirable phase rotation which can adversely effect the transient characteristics of the integrator, and thereby eliminate cumbersome integrator drift suppression circuitry. In embodiments of the invention such as those described hereinabove wherein separate branches having separate limit indicators are used to drive respectively associated ones of the electrical valves, variations in the operating characteristics of the components in the branches, with respect to each other, can result in asymmetrical operation which, like drift, will result in an undesirable D-C component in the network. The line synchronized control unit further functions to compensate for difficulties encountered in the use of the function generator for the function $\pm|V|^a$, which can be especially problematical in weak networks which produce wave shapes with multiple zero crossings.

In a still further embodiment of the invention, the problems described hereinabove are alleviated by providing a rectifier in series with a power raising function generator between the first measuring device and the first integrator, for forming the function $y=x^a$ for $x\geqq o$ and a being any desired value. The output of the integrator is combined with a quantity corresponding to the desired mean value, and conducted to the input of a limit indicator which is connected to the input of a pulse former. The output of the pulse former is connected to a pulse distributor and subsequently to the electrical valves. Circuitry may be provided for resetting the first integrator after a firing pulse and before the subsequent zero crossing of the voltage. Such resetting may be achieved by a supplemental pulse signal. This embodiment has the advantage of utilizing only a single limit indicator for both electrical valves. In addition, the integrator is reset to zero during each voltage half-wave, thereby eliminating the possibility of producing a D-C component on the network, because any zero drifts which would shift the electrical valve firings in time will always occur in the same direction, thereby maintaining symmetry.

This embodiment may be improved by providing a switch electrically disposed between the power raising function generator and the introduction into the circuit of the quantity corresponding to the desired mean value. In operation, such a switch would maintain an open state if the polarity of the instantaneous voltage coincides in polarity with the polarity of the voltage half-wave during the most immediate prior opening of an electrical valve. Illustratively, if the valve which is poled for conduction in the positive direction has been fired so as to compensate the positive voltage half-wave, the switch will remain opened until the voltage becomes negative. During this period, the integrator is set to zero. After the voltage crosses zero so as to become negative, such negative voltages are conducted to the integrator by closing the switch; however, if multiple zero crossings occur as a result of network fluctuations, the switch will open during all positive portions of the wave form. It is advantageous in this embodiment to connect the choke in series with the electrical valves, and also to measure the current flowing through the electrical valve by means of a measuring device. The output of the measuring device is conducted to a second rectifier and a second integrator, which second integrator is reset to zero almost concurrently with the first integrator. A second switch which operates in synchrony with the first switch is disposed between the second rectifier and the second integrator. The output signal of the second integrator is added to the output signal of the power raising function generator, and the combined signals are conducted to the input of the first integrator. Relatively simple logic circuitry may be provided for controlling the operation of the switches and the distribution of the firing pulses through the electrical valves. Additionally, the second integrator may be operated in synchrony with the first integrator so as to be maintained at zero until the next polarity change of the voltage, as described above.

BRIEF DESCRIPTION OF THE DRAWINGS

Comprehension of the invention is facilitated by reading the following detailed description in conjunction with the annexed drawings, in which.

DETAILED DESCRIPTION

Figure 1:
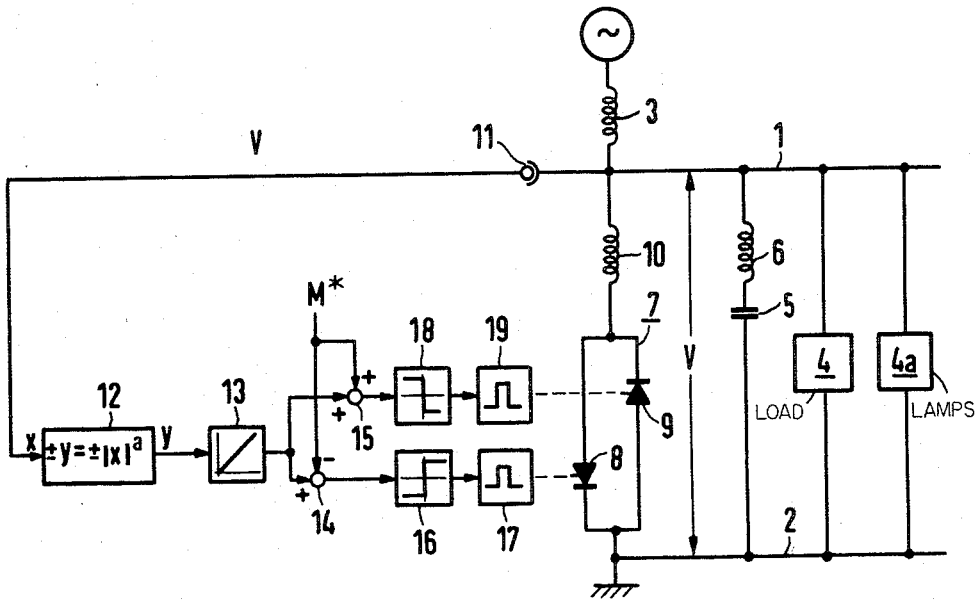
FIG. 1 is a schematic and block and line representation of a single phase circuit which operates in accordance with the principles of the invention.

FIG. 1 shows a single phase transmission network having conductors 1 and 2, conductor 2 being connected to ground. The internal impedance of the network is represented by a coil 3, which is electrically disposed between conductor 1 and a generator. A load 4 is conducted across conductors 1 and 2. Load 4 is of a type which has a rapidly changing impedance which causes undesirable electrical reactions in the network which have an undesirable effect upon incandescent lamps 4*a* of other consumers. A capacitor 5, which may be formed of a plurality of capacitors so as to form a capacitor battery is disposed in series with a choke 6 across conductors 1 and 2. The capacitor battery is predesigned so as to compensate for reactive current components occurring at maximum load currents. Although the capacitor battery is not essential to the operation of the invention, the capacitor battery provides the further advantage of maintaining a favorable power factor for the installation. Additionally disposed across conductors 1 and 2 is the serial combination of a coil 10 and an A-C control element 7. In this embodiment, control element 7 consists of two parallel thyristor valves 8 and 9 which are poled for conduction in opposite directions. A measuring device 11, which may be a voltage transformer, is connected at its input to conductor 1 and provides at its output a signal corresponding in amplitude to the network voltage V. Voltage signal V is conducted to an input of an integrator 13 by means of a function generator 12 which will be discussed below. Integrator 13 is of the type which has a zero voltage point which does not drift and which automatically compensates, over several periods, for any D-C components that may be present at its output. The output of the integrator is conducted to respective positive inputs of comparators 14 and 15. The comparators receive, at respective subtractive and additive inputs, a positive quantity M* which corresponds to the reference value of the voltage level, which reference value corresponds to a desired preset mean value of a voltage half-wave.

Thyristor 8 of the A-C control element 7 is poled for conduction during positive half-waves $V>O$. Comparator 14 which is associated with thyristor 8 produces at its output a signal corresponding to the difference between the output of integrator 13 and the preset mean value M*. The difference signal is conducted to limit indicator 16 which is coupled at its output to a pulse former 17, the combination of which provide a firing pulse for placing thyristor 8 in a conductive state. During negative half-waves ($V<O$), comparator 15 provides at its output a signal corresponding to the sum of the output of integrator 13, which is negative during negative half-waves of the network voltage, and the preset reference value M*. Thus, comparator 15 provides at its output a signal corresponding to the difference between the absolute value of the negative half-wave and the reference value. A limit indicator 18 receives at its input, the signal at the output of comparator 15, and is coupled at its output to a pulse former 19. Pulse former 19 provides firing pulses to place thyristor 9 in a conductive state.

During a positive half-wave of network voltage V, integrator 13, which during steady state operation begins the positive half-wave at a negative starting value, integrates the signal V until the value M* is reached. At this point, thyristor 8 is fired via comparator 14, limiter 16 and pulse former 17. During a negative half-wave, thyristor 8 is extinguished and the negative half-wave network voltage is controlled by thyristor 9 and its associated circuitry.

During the above operation, reference value M* corresponds to the desired reference value for the voltage-time product ($\int V dt$) of a half-wave. In some embodiments, however, it may be desirable to select a reference value M* which corresponds to a mean value of a predetermined function of the voltage V. Thus, M* can be selected as the reference value for $+\int V^a dt$ during the positive half-wave and negative M* as the reference value for $-\int |V|^a dt$ for the negative half-wave. The advantageous selection of a where $a>1$, permits the network voltage to be regulated by a quantity which is related to its RMS value. The realization of the above mathematical expressions is achieved by utilizing a power raising function generator 12 in combination with integrator 13. Function generator 12, which receives voltage signal V at its input, produces at its output a signal $\pm|V|^a$, which is positive if V is positive, and negative if V is negative. It should be noted that, in this embodiment, V will have an amplitude even during the conduction of the thyristors 8 and 9 because coil 10 serves to prevent short circuit conditions.

Figure 2:
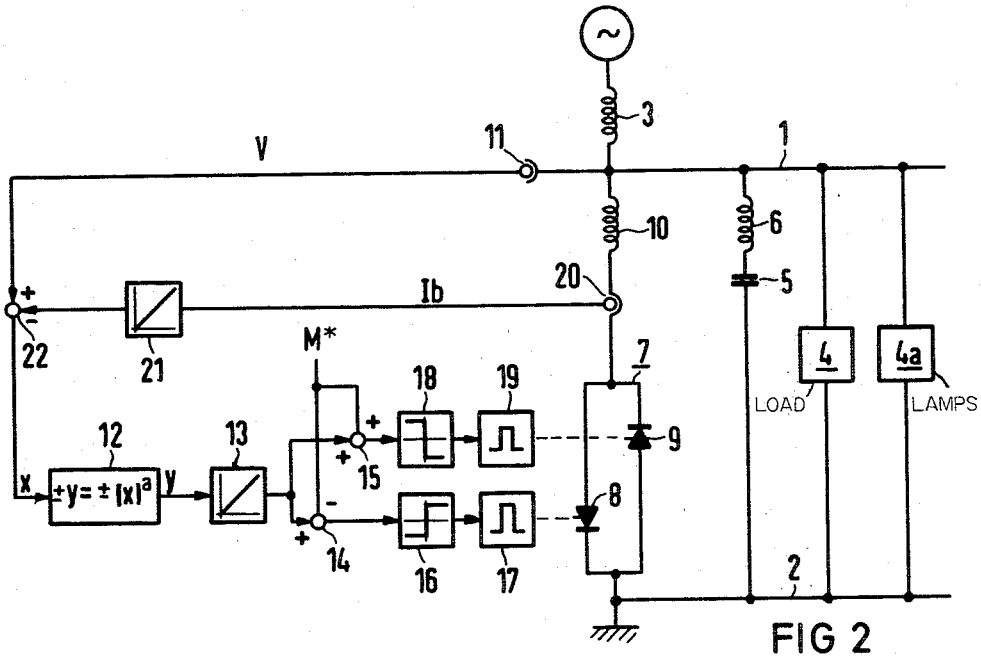
FIG. 2 is a second single phase embodiment of the invention, shown in schematic and block and line form, containing circuitry for compensating for voltage which is developed across a choke after the electrical valves have been fired.

The embodiment of FIG. 2 is similar to that of FIG. 1, but is further provided with a current measuring device 20, which may be a current transformer, which provides at its output a signal I*b* which corresponds to the current flowing through the control element 7; which signal is conducted to an integrator 21. Integrator 21 provides at its output a signal $\int Ib\,dt$ which is subtractively combined with the signal V in a summer 22. This additional circuitry compensates for the voltage which is developed across choke 10, even though the thyristors in control element 7 may be conductive, which voltage may be integrated by integrator 13 and would result in the integrated value exceeding the predetermined value M*. The advantageous selection of integration time constant $T_1$ of integrator 21 permits, at least during steady state operation, the adjustment of the signal delivered to the input of integrator 13 so that the condition $M^* = \int V^a\,dt$ is met in every half-wave. Using this circuitry, a voltage value $\int (V - \int Ib\,dt)^a dt$ is used for comparison with the reference value M*, so as to cause the instant of thyristor firing to be advanced in time and thereby compensate for the effect of the voltage present across coil 10 which would otherwise be integrated in integrator 13.

Figure 3:
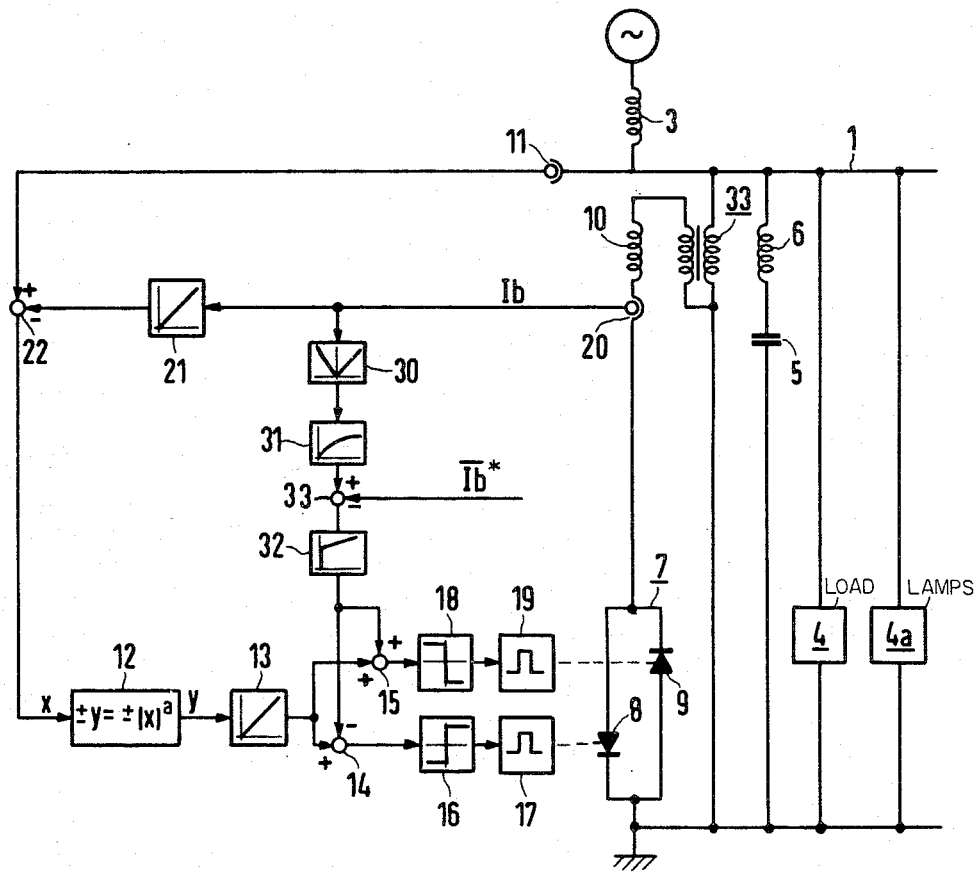
FIG. 3 is a schematic and block and line representation of an embodiment of the invention which compensates for long term variations in network voltage.

FIG. 3 shows an embodiment of the invention which is adapted to compensate for long term variations in the amplitude of the network voltage. A rectifier 30 is connected at its input to current transformer 20 so as to receive current signal I*b*. Rectifier 30 is coupled at its output to a smoothing filter 31 having a time constant $T_2$, in the order of several seconds. Smoothing filter 31 is connected at its output to a Pi-circuit 32 by means of summer 33. Summer 33 receives at an inverting input a value $\overline{Ib}^*$ which corresponds to the long term current mean. The output signal of Pi-circuit 32 is conducted to respective inverting and non-inverting inputs of comparators 14 and 15, as shown. This is, therefore, distinguishable from the embodiments of FIGS. 1 and 2 wherein the short term voltage reference value M* is conducted directly to the comparators 14 and 15. As seen over several periods, the reactive current components in the network which result from the variations in the rapidly varying impedance of load 4, will average to an approximately constant reactive current so as to form a relationship between the original reference value M* and the mean current I*b* flowing through A-C control element 7. The reference value of the half-wave mean (i.e., the RMS voltage) can be made responsive to long term variations in the amplitude of the line voltage by advantageously presetting the reference value $\overline{Ib}^*$. The effects of short term load impedance variations upon the network voltage, which, as previously indicated, lead to flickering of incandescent lamps 4*a*, are compensated as before by the rapidly operating control of integrator 13 and limit indicators 16 and 18.

FIG. 3 further shows that A-C control element 7 can be connected to the network by means of a transformer 33. If transformer 33 is such that it has a relatively large inductance, coil 10 may be omitted.

Figure 4:
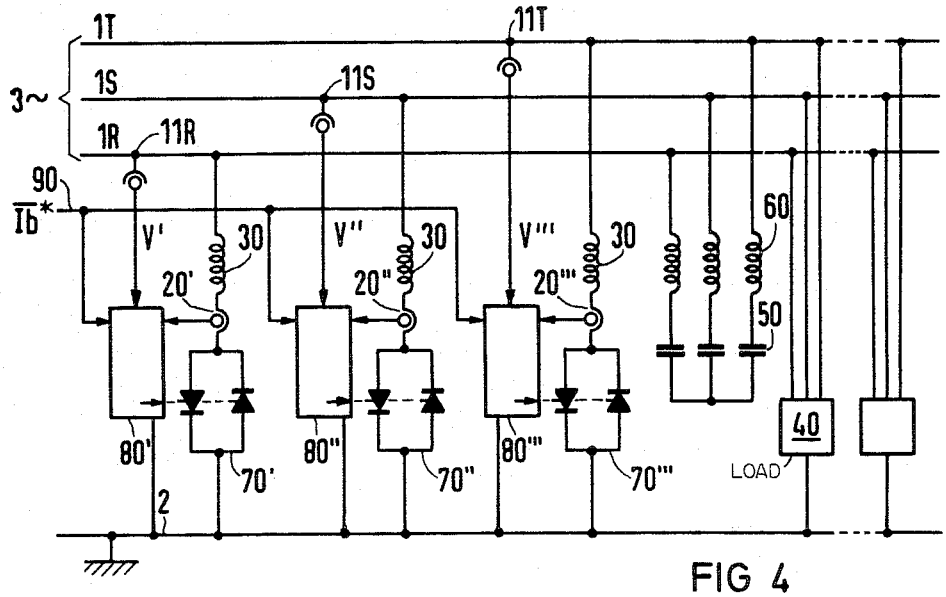
FIG. 4 is a schematic and block and line representation of a three-phase embodiment of the invention which is arranged in a "Y" configuration.

The embodiments of the invention described hereinabove with respect to FIGS. 1, 2 and 3 may be replicated so as to be utilized in multiphase A-C networks. Illustratively, each of the replicated control circuits may be applied in a "Y" configuration so as to be disposed between a phase conductor of the multiphase network and a neutral ground conductor. FIG. 4 illustrates how the control circuits described hereinabove may be applied to a three-phase transmission network having a neutral conductor.

In FIG. 4, the three phase conductors of a three-phase transmission network are shown as 1R, 1S and 1T. A three-phase load 40 is connected to each of the phase conductors and to a neutral conductor 2. A capacitor battery 50 comprised of at least three capacitors which are connected together at one end, are connected at their other ends to respective ones of the phase conductors by means of a plurality of coils 60. Control elements 70', 70'' and 7''' are each arranged in series combination with a respective coil 30 and electrically disposed between neutral conductor 2 and a respective one of the phase conductors. Control circuits 80', 80'' and 80''' receive respective voltage signals V', V'' and V''' by means of respective measuring devices 11R, 11S and 11T. The currents flowing through the control elements are measured by respective current measuring devices 20', 20'' and 20'''; each of which conducts a signal to a respective one of control circuits 80', 80'' and 80'''. The control circuits 80', 80'' and 80''' are constructed in accordance with the control circuit embodiments described hereinabove with respect to FIGS. 1, 2 and 3. Each of the control circuits also receives the reference value for the long term mean $\overline{Ib}^*$ of the currents flowing through the control elements, by means of a common conductor 90.

Figure 5:
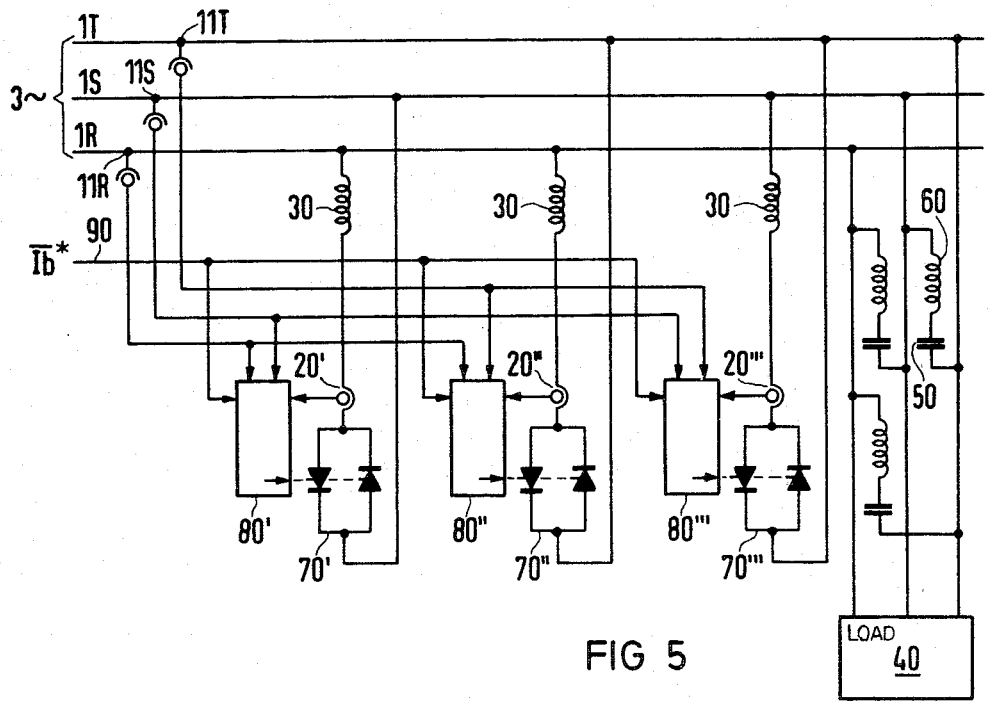
FIG. 5 is a schematic and block and line representation of a three-phase embodiment of the invention arranged in a "Δ" configuration.

FIG. 5 shows a three-phase embodiment of the invention which does not have neutral conductor. The circuit is arranged in a delta (Δ) whereby the control circuits 80', 80'' and 80'''; and the control elements 70', 70'' and 70''', are electrically disposed between respective ones of the phase conductors. In this embodiment, capacitor batteries 50 are arranged serially with respective coils 60 and electrically disposed between pairs of phase conductors.

Figure 6:
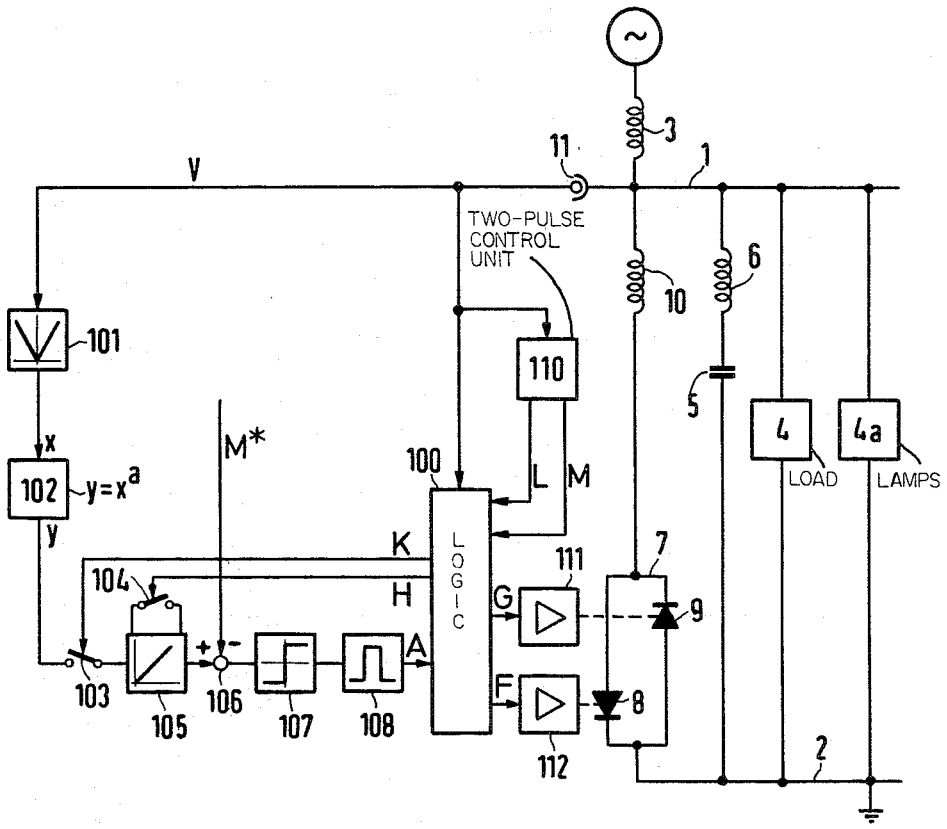
FIG. 6 is a schematic and block and line representation of single phase embodiment of the invention having circuitry for resetting the integrator to zero.

FIG. 6 shows an embodiment of the invention which utilizes a central logic circuit 100. Circuit elements designated by the reference numerals 1–11 correspond to the circuit elements described hereinabove with respect to FIGS. 1–5. Central logic circuit 100 provides firing pulses F and G to firing circuits 112 and 111 which are respectively associated with thyristors 8 and 9. A commercially available two-pulse control unit 110 is synchronized with voltage V at the output of voltage transformer 11. Two-pulse control unit 110 is adjusted by setting a constant control vector so that a supplemental firing signal L or M is added to the firing pulse F or G to the appropriate one of thyristors 8 and 9 at a predetermined time interval prior to the end of the respective half-wave of network voltage V.

In a preferred embodiment, a rectifier 101 is coupled at its output to an input of a power raising function generator 102, which provides the function $y = x^a$ for $x \geqq O$; and a being any value, preferably $> 1$. This function generator corresponds to function generator 12 in FIGS. 1, 2 and 3. A function generator of this type is described in Tietze-Schenke, "Halbleiterschaltungstechnik", Berlin, Heidelberg, New York, 4th Ed., 1978, page 212. In embodiments where a assumes integral values, multiplier circuits can be used. The degree of network voltage control is responsive to the advantageous selection of a.

Function generator 102 is coupled at its output by a switch 103 to an input of an integrator 105. Integrator 105 may be reset to a zero value by a switch 104. Switches 103 and 104 can be kept in a closed state by high logic state pulses of control signals K and H. The output of integrator 105 is combined with a negative reference mean value M*, in a summer 106. The output of summer 106 is conducted to the input of a limit indicator 107, which is coupled at its output to a pulse former 108. Pulse former 108 provides at its output a firing pulse during such times as the output of integrator 105 exceeds in magnitude the value M*. Logic circuit 100 distributes firing pulses A received from pulse former 108, and the supplemental firing pulses L and M, to firing circuit 111 and 112.

Figure 8:
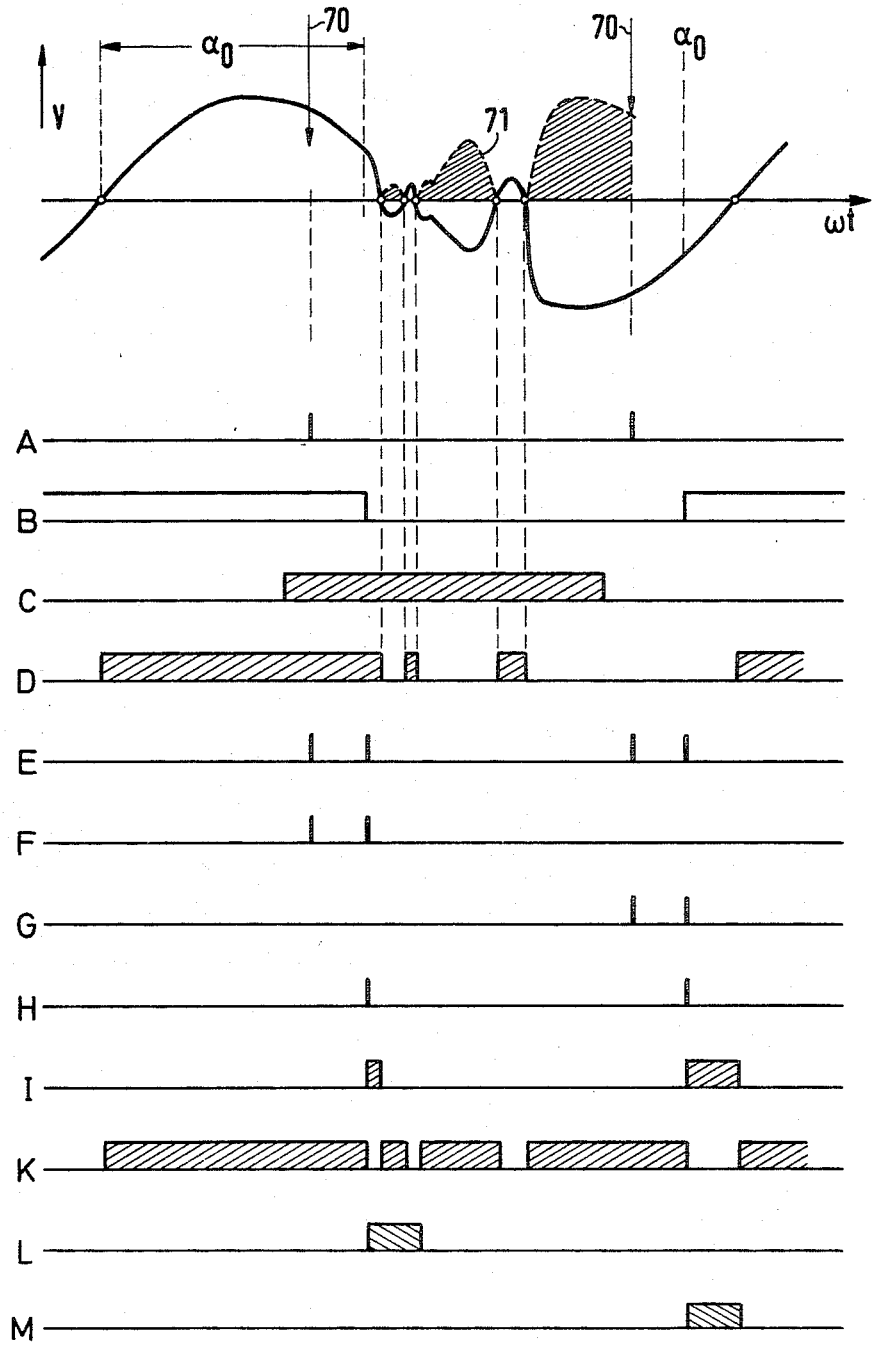
FIG. 8 is a timing diagram which is useful for explaining the operation of the embodiments in FIGS. 6 and 7.

FIG. 8 shows the timing relationship between the pulse signals A, F, G, K, L and M, and the wave form of the network voltage V, which have been discussed with respect to FIG. 6. FIG. 8 further shows the angular duration $\alpha_0$ which is designated as the control angle of the two-pulse control unit 110, which supplies the supplemental firing signals L and M for limiting the maximum cutoff interval of thyristors 8 and 9. The arrows 70 identify the angular instant where the output signal of integrator 105 coincides with the reference means M*. Switch 104 resets integrator 105 to zero in response to signal H and thereby prepares the integrator for producing the voltage-time product of a subsequent half-wave. Alternatively, such resetting occurs at the earliest of the first firing of a thyristor during a voltage half-wave (signal A), or the positive slope of supplemental firing signal L, if such slope is prior in time to pulse A. In an ideal situation, the resetting of the integrator should be accomplished at the very beginning of each new half-wave. However, in weak networks, several zero crossings usually follow one after the other, as shown in FIG. 8, thereby causing difficulties. Accordingly, resetting of integrator 105, in this embodiment, occurs simultaneously with the positive slopes of supplementary firing signals L and M.

The input signal of integrator 105 is shown in FIG. 8 for a=1 by the dashed wave form line 71. Although error would be introduced into the system by the fact that integration begins at some time other than the ideal moment which corresponds to the zero crossing of the fundamental voltage component of the network, such error is minimized by the closing and opening of switch 103 which permits only the portions of the voltage wave form which have negative polarity to be conducted to the integrator. The voltage-time area which is determined by the integrator and which is monitored by limit indicator 107 with respect to whether the reference mean M* is exceeded is shown shaded.

Figure 7:
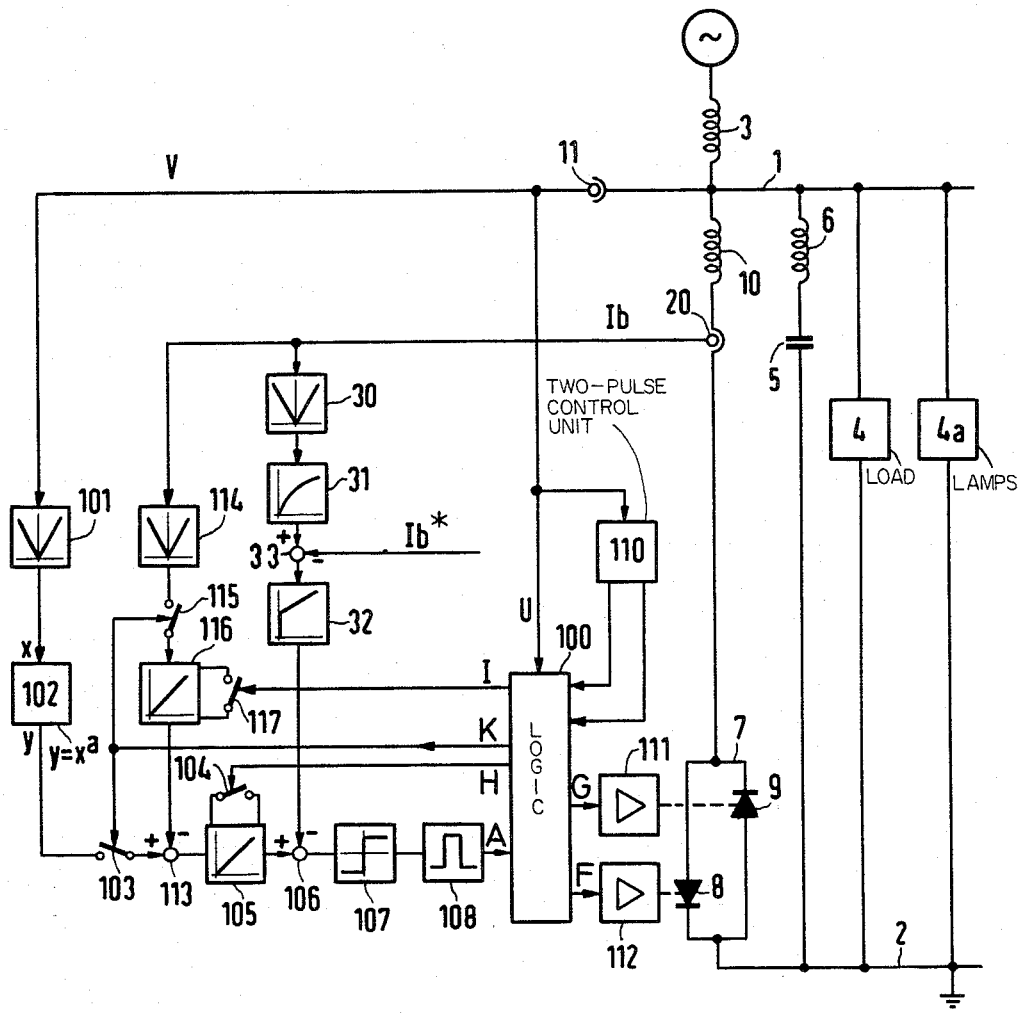
FIG. 7 is a schematic and block and line representation of an improvement to the embodiment of FIG. 6.
Figure 9:
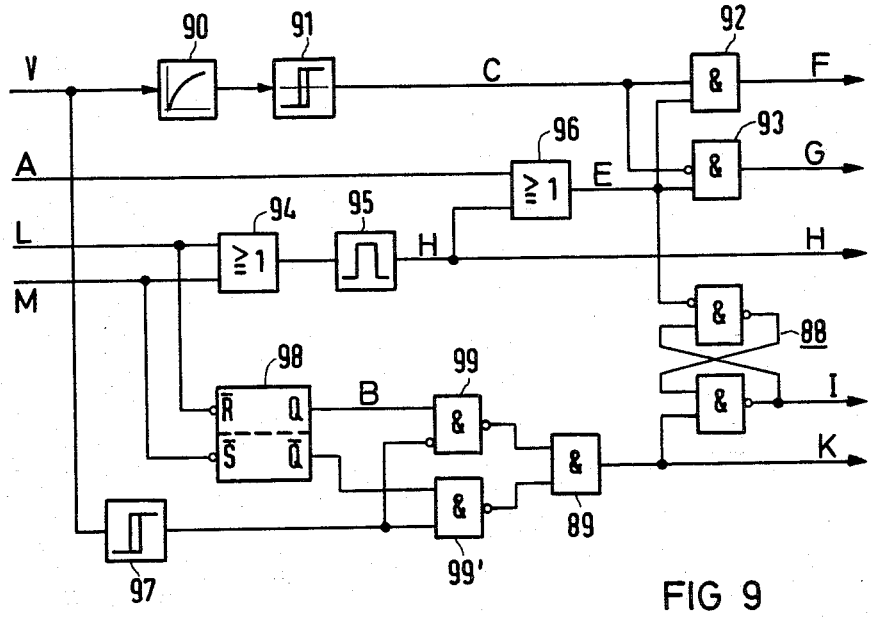
FIG. 9 is a block and line logic diagram of the design of the logic circuitry in FIGS. 6 and 7.

The remaining timing diagrams shown in FIG. 8 relate to the embodiment shown in FIG. 7 and the logic circuit 100 which is shown in detail in FIG. 9. In addition to the circuit components discussed with respect to FIG. 6, the embodiment of FIG. 7 further contains a current measuring device 20 to which are connected the series combination of a rectifier 30, a smoothing filter 31 and a Pi-circuit 32. Elements 30, 31 and 32, correspond structurally and operatively to the similarly identified elements in FIG. 3. The embodiment of FIG. 7 is further provided with a second rectifier 114 which is connected at its output to an input of a second integrator 116 by means of a switch 115. Switch 115, like switch 103, is opened in response to pulses K. As is the case with first integrator 105, second integrator 116, is preferably reset in the ideal case by the zero crossing of the fundamental voltage component of the network. However, in view of the above discussion concerning multiple zero crossings, integrator 116 can be simply reset without producing error by operation of resetting switch 117 which is closed at the beginning of a supplemental firing signal and remains closed until the time of the first zero crossing of the actual voltage wave form V, as shown by closing pulse I in FIG. 8.

FIG. 9 shows the logic block details of central logic circuit 100. Network voltage wave form V is conducted to an input of a time delay stage 90, which may be a second-order time delay stage which is coupled at its output to a limit indicator 91. Limit indicator 91 provides at its output a signal C which, as shown in FIG. 8, is in a high logic state for an interval during which are expected the firing of pulses A and the zero crossing of the network voltage wave form. Pulse signal C is conducted to AND gate 92 and to an inverting terminal of AND gate 93. Supplemental firing signals L and M are coupled to respective inputs of an OR gate 94 which is coupled at its output to a pulse former 95 which provides at its output a pulse H in response to the positive slope of the output of OR gate 94. Signal H is combined with firing pulses A at respective inputs of OR gate 96 which provides at its output a firing pulse sequence E. Firing pulse sequence E is coupled to respective inputs of AND gates 92 and 93. Signal H is provided at an output of the central logic circuit for operating reset switch 104 of integrator 105.

Signal K, which operates switch 103 and in some embodiments switch 115, is formed by the combination of signals L, M and network voltage V. Supplementary firing signals L and M are fed to respective inputs $\overline{R}$ and $\overline{S}$ of an RS flip-flop 98. The Q output of flip-flop 98 contains signal B which is conducted to an input of AND gate 99. The $\overline{Q}$ output is coupled to an input terminal of AND gate 99'. AND gates 99 and 99' receive at respective inverting and non-inverting inputs a signal from a limit indicator 97 which corresponds to the polarity of network voltage V. AND gates 99 and 99' are connected at inverted outputs to respective inputs of AND gate 89, which provides signal K at its output.

Reset switch 117 of integrator 116 is operated in response to signal I which is formed at the output of AND gates 88 which are cross-connected so as to form a memory circuit. Memory circuit 88 receives at an inverting input the signal E and at a non-inverting input the signal K.

It should be understood that the embodiment of the invention described hereinabove with respect to FIGS. 6, 7 and 9, can be applied to polyphase networks in view of this teaching. In addition, although the inventive concept disclosed herein has been described in terms of specific embodiments and applications, other applications and embodiments will be obvious to persons skilled in the pertinent art without departing from the scope of the invention. The drawings and descriptions of specific embodiments of the invention in this disclosure are illustrative of applications of the invention and should not be construed to limit the scope thereof.

What is claimed is:

1. A circuit for controlling a supply voltage between two conductors of an A-C network which supplies electrical power to a load having a rapidly changing impedance so as to maintain a half-wave mean supply voltage amplitude which corresponds to a predeterminable value, the circuit being of the type having at least a first controlled electric valve electrically disposed between the conductors, and a measuring device for producing a voltage signal responsive to the supply voltage on at least one conductor, the circuit being CHARACTERIZED IN THAT there is further provided:

valve control means for controlling the conduction state of the first controlled electric valve, said valve control means providing at least one firing pulse during a half-wave of the supply voltage which is of a first polarity so as to cause the first controlled electric valve to conduct, said firing pulse being responsive to a first signal corresponding to the difference between the amplitude of a first integration signal, corresponding to an integration of the voltage signal, and the predeterminable value; and supplementary firing signal means for producing a supplementary firing signal for placing the first controlled electric valve in a conductive state if the first controlled electric valve has been in a non-conductive state for a period exceeding a predetermined maximum time period.

2. The circuit of claim 1 wherein said supplementary firing signal means comprises a line synchronized control unit having a constant maximum cutoff period controlled by a constant drive angle.

3. The circuit of claim 1 wherein said valve control means further comprises:

first integrator means for producing said first integration signal;

limit indicator means for producing a difference signal responsive to the difference between said first integration signal and the predeterminable value; and pulse former means connected to said limit indicator means for providing said firing pulse in response to said difference signal.

4. The circuit of claim 3 wherein there is further provided a second controlled electric valve connected in parallel to the first controlled electric valve, and poled for conduction in a direction opposite to that of the first controlled electric valve, for controlling the supply voltage during a half-wave of the supply voltage of a second polarity during which the first controlled electric valve is non-conductive.

5. The circuit of claim 4 wherein there are further provided:

rectifier means connected to the measuring device for rectifying the voltage signal; and function generator means connected to said rectifier means for producing a function signal corresponding to a mathematically raised power of said rectified voltage signal from said rectifier means.

6. The circuit of claim 4 wherein said first integrator means can be reset to a zero value in response to said supplementary firing signal.

7. The circuit of claim 5 wherein there is further provided switch means connected to an output of said function generator means for discontinuing said function signal if the polarity of the half-wave of the network voltage during an immediately prior firing pulse corresponds to the polarity of of the instantaneous voltage.

8. The circuit of claim 3 wherein there is further provided a function generator means at an input of said first integrator means for transforming the voltage signal in accordance with $\pm y = \pm |X|^{a}$.

9. The circuit of claim 1 wherein there is further provided a choke connected in series with the first controlled electric valve.

10. The circuit of claim 9 wherein there are further provided:

current measuring means for providing a current signal responsive to the amplitude of current flowing through the first controlled electric valve;

second integrator means connected to said current measuring means for providing a second integration signal responsive to the mathematical integral of said current signal; and means for negatively combining said second integration signal with the voltage signal.

* * * * *